US005104041A

United States Patent [19]

Remington

[11] Patent Number: 5,104,041

[45] Date of Patent: Apr. 14, 1992

[54] RAIL BRACE ASSEMBLY

[75] Inventor: James A. Remington, Richton Park, Ill.

[73] Assignee: ABC Rail Corporation, Chicago, Ill.

[21] Appl. No.: 590,781

[22] Filed: Oct. 1, 1990

[51] Int. Cl.[5] ..... E01B 9/60

[52] U.S. Cl. ..... 238/292; 238/336

[58] Field of Search ..... 238/292, 336, 293, 337, 238/318, 343, 331, 349

[56] References Cited

U.S. PATENT DOCUMENTS

| | | | |
|---|---|---|---|
| 1,355,814 | 10/1920 | Coleman | 238/292 |
| 1,545,411 | 7/1925 | Edwards | 238/292 |
| 2,600,183 | 6/1952 | Arnold et al. | 238/292 |
| 2,636,687 | 4/1953 | Arnold et al. | 238/292 |
| 4,566,630 | 1/1986 | Keiper, Jr. | 238/292 |
| 4,770,342 | 9/1988 | Farrell et al. | 238/292 X |
| 4,824,015 | 4/1989 | Farrell et al. | 238/336 |

*Primary Examiner*—Frank E. Werner

*Assistant Examiner*—James Eller

*Attorney, Agent, or Firm*—Thomas S. Baker, Jr.

[57] ABSTRACT

A rail brace assembly for buttressing the head of a traffic rail as a rail brace with upper and lower slanted surfaces adapted to engage corresponding surfaces on a traffic rail. The rail brace assembly includes a bearing insert having a main body portion with a top surface adapted to engage a resilient fastener, a bottom surface adapted to engage a rail brace and a downwardly depending leg adapted to be received in an opening defined in a brace plate which engages a bearing surface on the rail brace and a bearing surface on the brace plate to cause lateral loads applied to the rail brace on the bearing insert to be resisted by the brace plate. Also, the rail brace assembly includes a shoulder secured to the top surface of a brace plate adapted to receive one leg of a resilient fastener and a resilient fastener having one leg adapted to be inserted into a shoulder opening and another leg adapted to engage the top surface of a bearing insert.

13 Claims, 3 Drawing Sheets

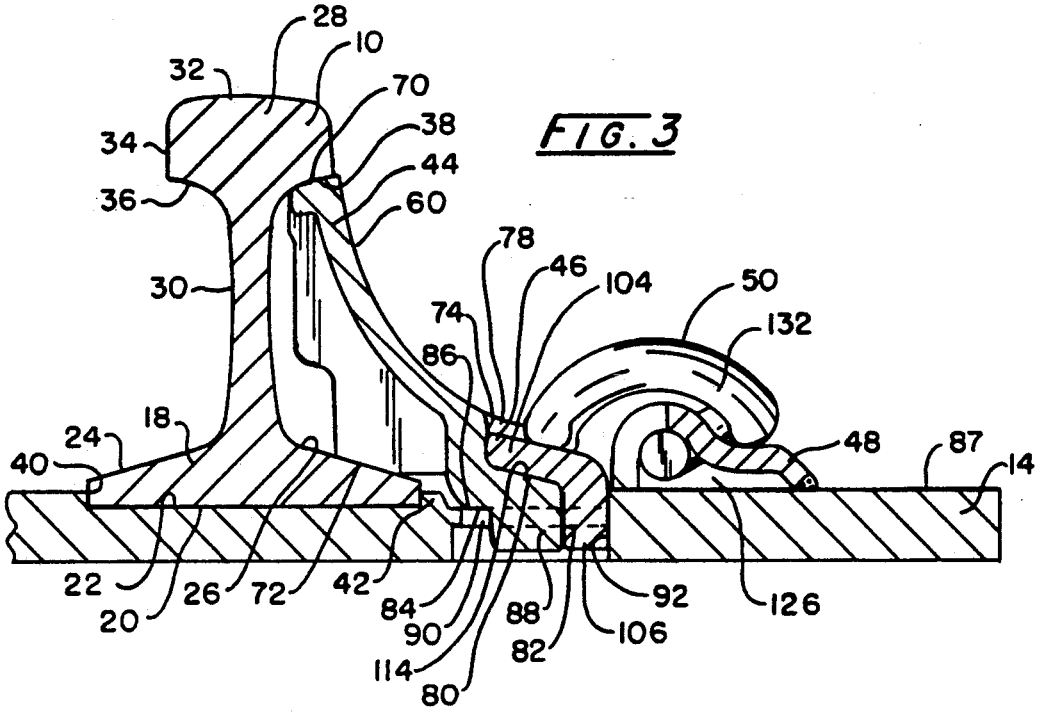
FIG. 3
FIG. 4
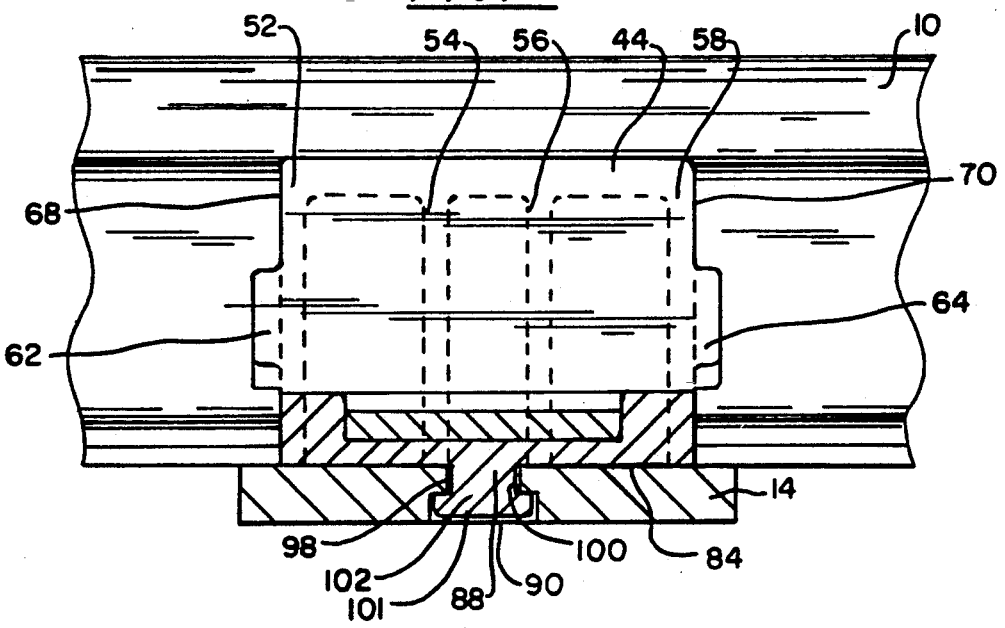

RAIL BRACE ASSEMBLY

BACKGROUND OF THE INVENTION

Rail braces are utilized to buttress railroad rails against side thrusts exerted by the wheels of rail traffic tending to overturn them. Side thrusts of a magnitude sufficient to overturn a rail most commonly occur at curved sections of the rail which are subjected to high speed rail traffic. When a rail is overturned, the head of the rail is rotated about its origin to a position in which it is offset angularly with respect to a straight line extending from the base through the vertical axis of the rail. The head of a rail rotates with respect to the base of the rail when the lateral forces exerted by rail traffic on the head of the rail are of a sufficient magnitude to overcome the force of the mechanism which anchors the base of the rail to the rail ties. Rotation of the rail head must be prevented at all sections of the rail inasmuch as if a lateral load sufficient to rotate a rail head is applied to the head of a rail over a relatively long length of the rail it is possible that the lateral load could cause the entire rail to roll over and ultimately collapse.

Rail braces are utilized to support a rail and to resist lateral movement of the head of the rail. These braces typically have an upper surface which bears against a fishing surface formed on the underside of the head of the rail and a lower surface which bears against a fishing surface formed on the top side of the base of the rail on the side of the rail opposite that engaged by the flange of a railroad car or locomotive wheel. Traditionally, rail braces have been anchored by being spiked to a wooden tie. However, rail braces anchored in this manner eventually loosen and it becomes necessary periodically to tighten the brace so that it engages firmly the base and head of the rail. Where a brace has been spiked to a railroad tie, it becomes necessary to remove the spikes and redrive them in order to retighten the brace. Eventually, the railroad tie must be replaced because it has been "spiked killed". In order to prevent railroad ties from being spiked killed as a result of removing and replacing spikes to tighten rail braces it has become a common practice to support railroad rails and rail braces on metal brace plates which in turn are anchored to railroad ties.

In addition to the utilization of brace plates it has become common practice to utilize adjustable rail braces which together with the metal brace plates eliminate the need to respite the brace assembly each time a rail brace must be tightened. In one type of adjustable brace, one side of the base of the brace is set at an angle and this side directly engages a stop welded to the brace plate and set at a similar angle to thereby provide a wedging action of the brace between the rail and the stop. In another type of adjustable brace, a wedge is interposed between the rail brace and the stop affixed to the brace plate. In both of these assemblies, the brace must be driven into frictional engagement with the stop or the wedge to firmly secure the rail brace into abutting contact with the rail. After the brace or wedge and brace assemblies have been driven into position, the brace assembly is secured by fasteners such as screws or nuts and bolts. Unfortunately, it has been found that where screws or nuts and bolts are utilized to secure a rail brace assembly to a brace plate, it becomes necessary to inspect periodically the brace assembly to determine if the fasteners have loosened and the braces have moved with respect to the rail. Obviously, when looseness of the brace assembly has been observed, track work maintenance personnel must loosen the fasteners, drive the wedge or brace into engagement with the rail and thereafter resecure the fasteners. Such inspection and tightening of braces by track personnel has increased greatly the cost of maintaining rail lines. Additionally, such maintenance practice necessitates the use of relatively skilled maintenance personnel who must be able to determine the proper degree of tightness for a rail brace.

Because of the time and expense involved in having maintenance personnel inspect and tighten fasteners which secure rail braces to rails, the railroad industry has moved to utilize elastic fasteners such as spring clips to bias rail brace assemblies against stock rails. In one type of adjustable brace assembly utilizing an elastic fastener, one side of the base of the brace is set at an angle with respect to the surfaces on the rail which engage the brace and the angled side of the base engages a stop mounted on a brace plate having a complementary angled face to thereby provide a frictional wedging action for urging the brace against the rail. In this assembly an elastic fastener biases a cover plate downwardly against a flat surface formed on the top of the brace to prevent vertical and horizontal movement of the brace. The surface of the brace may be corrugated and engage a similarly corrugated surface formed on the bottom of the cover plate to further inhibit longitudinal movement of the brace. In this assembly lateral loads applied to the rail brace assembly must be absorbed by a stop affixed to the top surface of a brace plate. Such an assembly may be seen in U.S. Pat. No. 4,566,630.

Another rail brace assembly utilizing an elastic fastener to bias a rail brace assembly into contact with a rail may be seen by referring to U.S. Pat. No. 4,824,015 assigned to the Assignee of the present invention. In this assembly a rail brace is supported on a brace plate and has a downwardly depending lug which becomes trapped within a slot in the brace plate when the rail brace contacts the traffic rail. A resilient fastener biases the rail brace into contact with the track rail. In this assembly rotational and longitudinal forces exerted on the rail brace are absorbed by the lug and brace plate interface whereas lateral forces exerted on the rail brace are counteracted by the elastic fastener.

It has been found that at certain locations in railroad track work and under certain conditions which occur very infrequently, extremely high lateral loads or "spike loads" are applied to brace assemblies from rail traffic. Maximum resistance to these lateral loads is required to properly brace the track rail at these locations. In rare instances, the horizontal component of force may approach the resisting horizontal force component of the resilient fastener.

It has been found that by transferring the lateral component of force exerted on a rail brace assembly to a brace plate that maximum resistance to the lateral load is provided. Transferring the lateral load to the brace plate eliminates the need for welding an auxiliary member such as a stop to the brace plate and adequately resists the very high "spike loads" encountered at certain rail locations.

SUMMARY OF THE INVENTION

The subject invention relates to a rail brace assembly for buttressing the head of a rail resting on the top surface of a brace plate by engaging fishing surfaces formed on the head and base of the rail. The assembly includes a rail brace having an upper slanted surface for engaging the head fishing surface, a lower surface for engaging the base fishing surface, a bottom surface adapted to rest upon the brace plate, a front bearing surface and an upwardly facing top surface. This assembly also includes a bearing insert having a main body portion with a pair of laterally extending side walls, a top surface adapted to engage a resilient fastener, a bottom surface adapted to engage the top surface of the rail brace and a downwardly depending leg adapted to be received in an opening defined in the brace plate. The bearing insert has a first bearing surface for engaging the front bearing surface of the rail brace and a second bearing surface for engaging a wall defining the brace plate opening to cause lateral loads applied to the brace and the bearing insert to be resisted by the brace plate. The assembly has a shoulder rigidly secured to the top surface of the brace plate with an opening for receiving one leg of a resilient fastener. A resilient fastener having another leg adapted to engage the top surface of the insert acts to apply a downwardly acting force on the top surface of the rail brace to resist rotational movement of the rail brace.

The invention further comprises a rail brace for buttressing the head of a rail resting on the top surface of a brace plate by engaging fishing surfaces formed on the head and base of the rail and adapted to engage a bearing insert. The brace comprises an upper slanted surface for engaging the head fishing surface, a lower surface for engaging the base fishing surface, a bottom surface adapted to rest upon the brace plate, a front bearing surface, an upwardly facing top surface and an upper bearing surface.

The invention also comprises a bearing insert adapted to receive lateral loads from a rail brace and vertical loads from a resilient fastener having a main body portion with a pair of laterally extending side walls, a top surface adapted to engage a resilient fastener, a bottom surface adapted to engage the top surface of a rail brace and a downwardly depending leg adapted to be received in an opening defined in a brace plate. This leg has a first bearing surface for engaging the front bearing surface of a rail brace and a second bearing surface for engaging a wall defining the brace plate opening.

BRIEF DESCRIPTION OF THE DRAWINGS

FIG. 3 is a transverse sectional view along line 3—3 of FIG. 2;

FIG. 4 is a sectional view along line 4—4 of FIG. 2;

DESCRIPTION OF THE INVENTION

Figure 1:
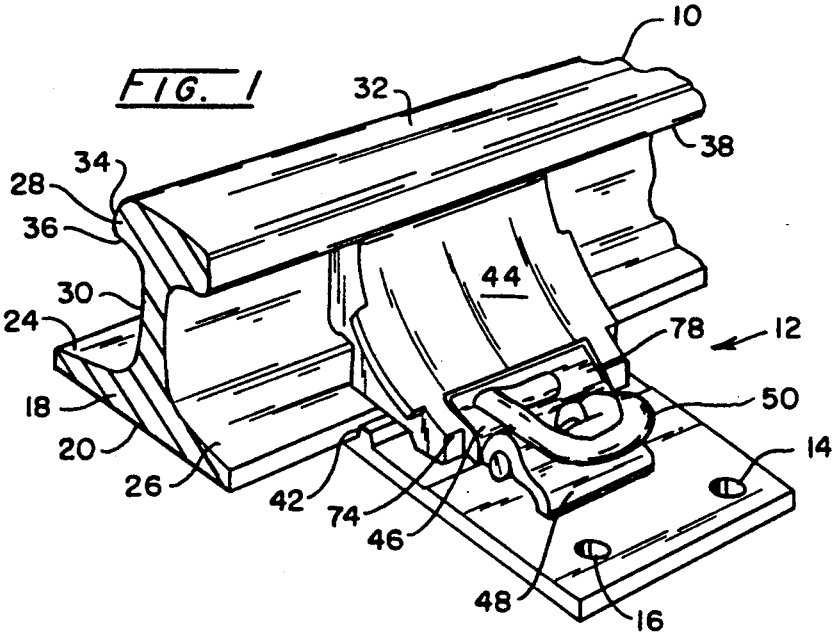
FIG. 1 is a perspective view of the first embodiment of the rail brace assembly of the instant invention.

Turning to FIG. 1 of the drawings, a stock rail (10) and the rail brace assembly (12) are shown seated upon a metal brace plate (14). Plate (14) has holes (16) for receiving spikes or bolts used to fasten the brace plate (14) to a railroad tie, not shown which may be constructed of wood, steel, concrete or any other type of acceptable material. Rail (10) includes a generally laterally extending base (18) having a bottom surface (20) adapted to rest upon the top surface (22) of brace plate (14) and a pair of lower inclined top surfaces (24 and 26) which commonly are referred to as base fishing surfaces The rail (10) also includes a head (28) which is connected to base (18) by a vertical web (30) and which includes a top surface (32) that engages the treads of railroad car and locomotive wheels. Head (28) also has a vertical surface (34) which contacts flanges on the wheels of railroad vehicles and receives lateral loads therefrom and a pair of angled underside surfaces (36 and 38) that commonly are referred to as head fishing surfaces.

As previously discussed, the rail brace assembly (12) of the present invention acts to buttress the head (28) of rail (10) to prevent it from rolling or becoming angularly displaced with respect to the vertical axis of the rail (10) when lateral loads are imposed upon it from rail traffic passing over rail (10). Secondarily, the rail brace assembly (12) functions to clamp the rail base (18) against a shoulder (40) formed in brace plate (14) as shown in FIG. 3. A shoulder (42) defines the edge of top surface (22) opposite that defined by shoulder (40) in brace plate (14). Clamping rail (10) against shoulder (40) formed in base plate (14) acts to maintain the gauge of the track.

The rail brace assembly (12) buttresses the side of the rail (10) opposite that which engages the flange of railroad vehicle wheels. Rail brace assembly (12) includes a unitary brace (44) which engages the base and head fishing surfaces (26 and 38) respectively on rail (10), a bearing insert (46) which transfers lateral loads applied to brace (44) to brace plate (14), a shoulder (48) and an elastic fastener (50) which engages bearing insert (46) and shoulder (48) to resist clockwise rotation of brace (44) and to assist in resisting lateral movement thereof as will be discussed in detail hereinafter.

Rail brace (44) may be constructed as a unitary casting having four equally spaced vertical ribs (52 through 58), a concave front surface (60) and a pair of handling tabs (62 and 64) which project longitudinally from each side (66 and 68) respectively of surface (60) as shown in FIG. 4. Rail brace (44) has a slanted upper surface (70) which intersects the curved front surface (60) and is adapted to engage the head fishing surface (38) on rail (10) when installed on brace plate (14). A slanted lower surface (72) formed on the back side of brace (44) extends in a generally longitudinal direction along the bottom of ribs (52 through 58) and engages the base fishing surface (26) when the brace (44) functions to support the head (28) of rail (10). Turning to FIG. 3 of the drawings, it may be seen that a portion of the lower surface of concave front surface (60) terminates in an indented space defined by a lateral ridge or upper bearing surface (74) and a pair of spaced side walls (76 and 78) best seen in FIG. 2. Turning again to FIG. 3 it may be observed that lateral ridge (74) extends downwardly and intersects a generally horizontally extending upwardly facing top surface (80). Top surface (80) preferably is inclined with respect to the top surface (22) of brace (14) at the same angle of inclination as is the base fishing surface (26). However, top surface (80) may be inclined at any preferred shallow angle or may be parallel to surface (22). Top surface (80) intersects a vertical front bearing surface (82) which defines one side along the perimeter of brace (44). Brace (44) has a bottom surface (84) adapted to rest upon the top surface (86) of brace plate (14).

It may be observed that a T-shaped lug (88) projects downwardly from the central portion of the bottom surface (84) of brace (44). Lug (88) passes through a keyhole shaped opening (90) formed in brace plate (14). Opening (90) has an enlarged area partially defined by a back wall (92) and side walls (94 and 96). Opening (90) has a narrower area defined by side walls (98 and 100).

The T-shaped cross sectional area of lug (88) may be seen best by referring to FIG. 4. The head (101) of lug (88) is wider than the body (102) which attaches to bottom surface (84) of brace (44). When rail brace (44) has been moved against rail (10), the body (102) of lug (88) is received within the slot in brace plate (14) defined by the walls (98 and 100). Since the slot defined by these walls is narrower than the width of head (101) lug (88) is captured within the slot and cannot be lifted vertically upwardly from brace plate (14). Obviously, the enlarged portion of opening (90) is large enough to accommodate lug (88). Consequently, rail brace (44) must be moved to the right such that lug (88) projects downwardly through brace plate opening (90) in the enlarged area defined by back wall (92) and side walls (94 and 96) in order to insert or remove rail brace (44) from brace plate (14).

Figure 2:
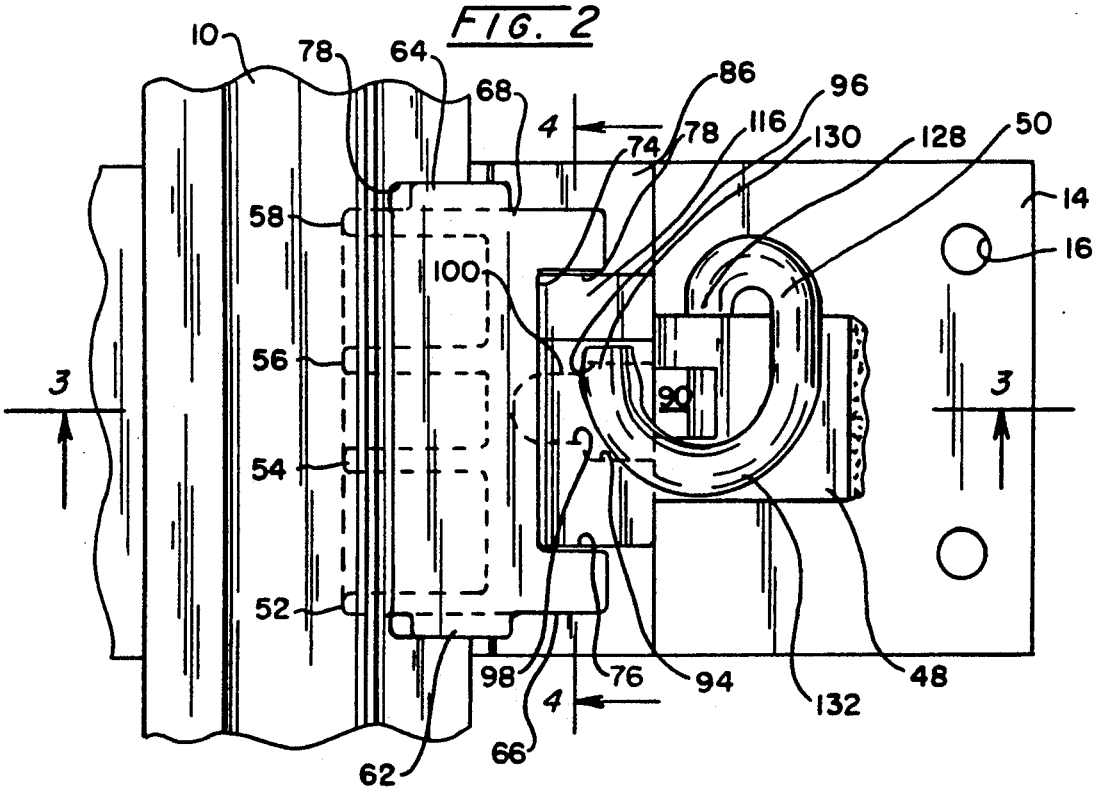
FIG. 2 is a top view of the rail brace assembly of FIG. 1.
Figure 5:
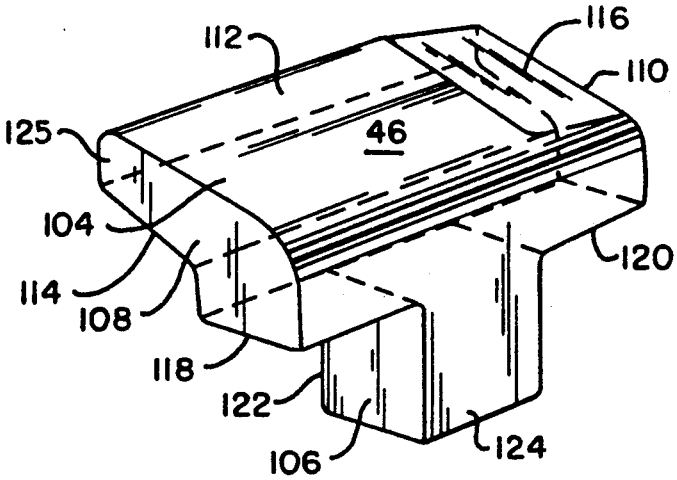
FIG. 5 is a perspective view of a bearing insert utilized in the rail brace assembly.

Referring to FIGS. 2 and 3, it may be seen that bearing insert (46) has a main body portion (104) which overlies the indented portion of rail brace (44) defined by upper bearing surface (74) and side walls (76 and 78). Bearing insert (46) also has a leg (106) which depends downwardly from main body portion (104) and occupies plate opening (90) between the vertical front bearing surface (82) of brace (44) and the back wall (92) which partially defines the opening (90) in plate (14). Bearing insert (46) may be seen in more detail by referring to FIG. 5. The main body portion (104) of bearing insert (46) has a pair of laterally extending side walls (108 and 110), a top surface (112) and a bottom surface (114). A tapered ramp (116) is formed in one side of bearing insert (46) to ease the installation of a resilient fastener in the rail brace assembly as will be described hereinbelow. The main body portion (104) of insert (46) also includes a pair of horizontal surfaces (118 and 120) formed adjacent each side of leg (106). Horizontal surfaces (118 and 120) rest upon the top surface (86) of plate (14) after leg (106) of bearing insert (46) has been inserted into opening (90) and the main body portion (104) engages rail brace (44) as depicted in FIG. 3. A pair of vertical bearing surfaces (122 and 124) are formed on two surfaces of insert leg (106). Bearing surface (122) engages the vertical front bearing surface (82) of rail brace (44) and vertical bearing surface (124) engages wall (92) partially defining opening (90) after bearing insert (46) has been placed in the rail brace assembly as depicted in FIG. 3.

A shoulder (48) is rigidly affixed to a top surface (87) of brace plate (14) by welding or any other suitable method. Shoulder (48) has an opening (126) adapted to receive the elastic fastener (50). It should be noted that shoulder (48) rests upon surface (87) in such a manner that bearing insert (46) does not contact the shoulder (48) when it becomes part of the rail brace assembly as illustrated in FIG. 3.

Resilient fastener (50) has a first leg (128) adapted to be inserted into shoulder opening (126) and a second leg (130) adapted to engage the top surface (112) of bearing insert (46). A curved section (132) connects the two legs (128 and 130) as may be seen best by referring to FIG. 2.

Installation of the rail brace assembly of the present invention may be accomplished by relatively unskilled personnel and may be explained by referring to FIGS. 1 through 4. To install rail brace (44), it must be positioned such that T-shaped lug (88) projects through the enlarged portion of (90) in brace plate (14). Thereafter the rail brace (44) is moved to the left as viewed in FIG. 3 such that lug (88) passes through the slot defined by walls (98 and 100) in brace plate (14). Rail brace (14) is moved until the slanted surfaces (70 and 72) engage the head and base fishing surfaces (38 and 26) formed on rail (10). In this position of rail brace (44) the bottom surface (84) rests upon the top surface (86) of brace plate (14). Since T-shaped lug (88) resides within the slot (98 and 100), the rail brace (44) cannot be moved upwardly with respect to brace plate (14). Thereafter, bearing insert (46) is positioned in the indented portion of rail brace (44) formed by upper bearing surface (74) and side walls (76 and 78) such that the bottom surface (114) of the insert engages the upwardly facing top surface (80) of brace (44). Additionally, the upper bearing surface (125) of insert (46) engages the upper bearing surface (74) of brace (44). In this position the downwardly depending leg (106) of insert (46) is inserted into the brace plate opening (90) such that the front vertical bearing surface (122) engages the vertical front bearing surface (82) of rail brace (44) and the rear vertical bearing surfaces (124) engages the back wall (92) of brace plate (14) which defines opening (90). Lastly, the elastic fastener (50) is driven into position by means such as a sledge hammer by causing leg (128) to be forced into opening (126) in shoulder (48) and leg (130) to rest upon and apply a downwardly directed force on bearing insert top surface (112). It may be seen that the tapered ramp 116 on bearing insert (46) assists leg (130) in sliding onto surface (112). Referring to FIG. 3, it may be seen that the downward component of force exerted on the bearing surface (112) may be resolved into a vertically downwardly directed component and a laterally directed component tending to drive the brace (44) into contact with the rail (10).

Again looking at FIG. 3, it may be seen that when a rail vehicle applies a lateral force to the surface (34) of rail head (28) the lateral component of force also will be applied to rail brace (44). This force will be transmitted through brace (44) and bearing insert (46) to the wall (92) of brace plate (14). Bearing insert (46) and brace plate (14) may be sized to enable them to withstand any very high peak or "spike" lateral loads which may be applied to the head (28) of rail (10). Forces tending to rotate rail brace (44) are absorbed at the interface of T-shaped lug (88) and brace plate (14). This interface also acts to prevent longitudinal movement of rail brace (44) with respect to rail (10). Longitudinal movement of bearing insert (46) with respect to brace (44) does not occur inasmuch as the main body portion (112) of the insert (46) resides within the indented portion of brace (44).

Although upper bearing surface (125) of bearing insert (46) is shown engaging the upper bearing surface (74) of rail brace (44) the lateral forces transmitted to the rail brace (44) also may be absorbed satisfactorily at the interface of bearing insert (46) and brace plate (14) solely by having brace plate bearing surface (122) contact the front bearing surface (82) of rail brace (44)

and the vertical bearing surface (124) contact brace plate wall (92).

Figure 6:
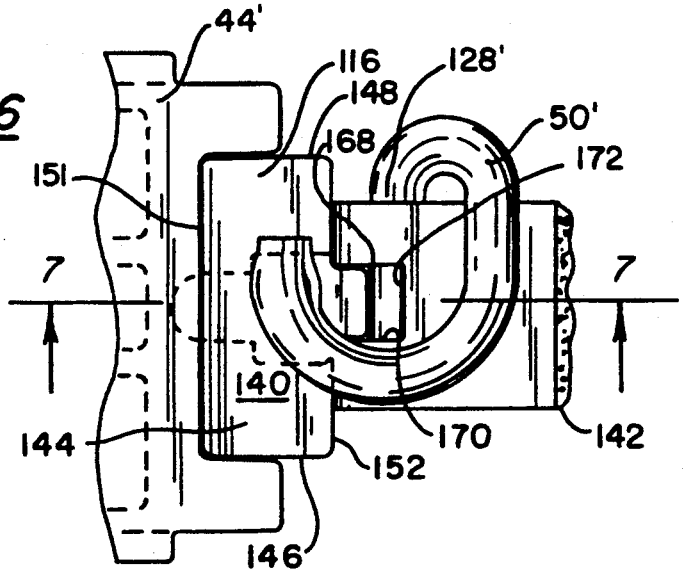
FIG. 6 is a top view of the second embodiment of the rail brace assembly of the present invention.
Figure 7:
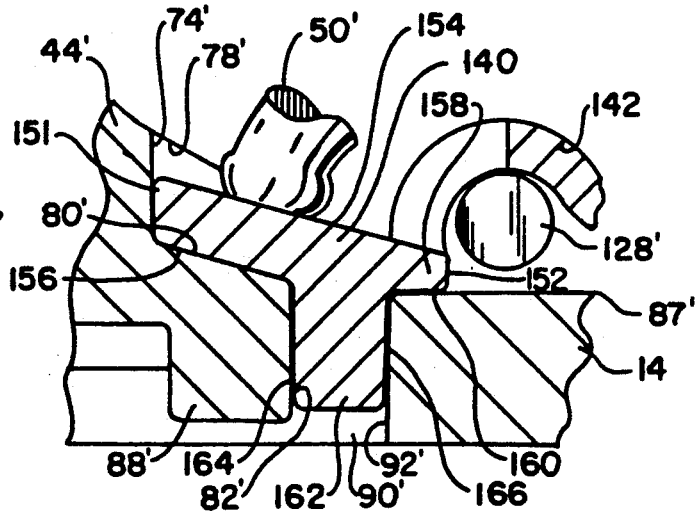
FIG. 7 is a view along line 7—7 of FIG. 6.

A second embodiment of a bearing insert (140) may be seen by referring to FIGS. 6 and 7. The bearing insert (140) may be used with the standard rail brace (44) described above and the standard resilient fastener also described above. The bearing insert (140) requires a minor modification to the shoulder identified by the numeral (142). Items identical to those depicted in FIGS. 1 through 5 will be identified by identical prime numerals in FIGS. 6 and 7. Bearing insert (140) includes a main body portion (144) defined partially by a pair of lateral side walls (146 and 148), an upper bearing surface (151) and a lower edge (152). Insert (140) also has a top surface (154) adapted to contact an elastic fastener (50') and a bottom surface (156) adapted to engage the upwardly facing top surface (80') formed on a rail brace (44'). The main body portion (144) also has a lateral projection (158) with a downwardly facing contact surface (160) adapted to engage the top surface (87') of a brace plate (14'). The lateral projection (158) provides additional resistance to forces exerted on the rail brace (44') tending to rotate brace (44') and bearing insert (140). Bearing insert (140) also comprises a downwardly depending leg (162) having a front bearing surface (164) adapted to contact a vertical front bearing surface (82') formed on brace (44') and a rear bearing surface (166) adapted to engage a vertical wall (92') which partially defines space (90') which receives leg (162) and brace lug (88'). Turning to FIG. 6, it may be seen that shoulder (142) has a cutout portion defined by a pair of spaced lateral side walls (168 and 170) and a rear wall (172). Obviously, the cutout portion defined by the aforementioned walls provides space for the lateral projection (158) formed on the insert (140). Other than the aforementioned cutout portion, shoulder (142) is the same as shoulder (48) described in connection with the embodiment of bearing insert (46) depicted in FIGS. 1 through 5. Of course, the bearing insert (46) depicted in FIG. 5 also may be utilized in conjunction with shoulder (142) as well as with shoulder (48). It should be noted that bearing insert (140) like bearing (46) contacts only the rail brace and the brace plate to transfer lateral loads exerted on the rail brace to the brace plate. Bearing insert (140) does not contact shoulder (142).

From the above, it may be seen that the rail brace utilized in conjunction with the bearing insert of the present invention functions to transfer lateral forces imposed upon the rail brace by a rail directly to a brace plate. With this assembly very large peak or "spike" lateral loads from rail traffic may be resisted without causing the rail brace to loosen or lose contact with the traffic rail.

Since certain changes may be made in the above-described system and apparatus without departing from the scope of the invention herein involved, it is intended that all matter contained in the description or shown in the accompanying drawings shall be interpreted as illustrative and not in a limiting sense.

I claim:

1. A rail brace assembly for buttressing the head of a rail resting on the top surface of a brace plate by engaging fishing surfaces formed on the head and base of the rail which comprises:

a brace plate;

a through opening defined by a wall in said brace plate;

a rail brace having an upper slanted surface for engaging the head fishing surface, a lower slanted surface for engaging the base fishing surface, a bottom surface adapted to rest upon said brace plate, a front surface, a vertical front bearing surface and an upwardly facing top surface;

a bearing insert having a main body portion with a pair of laterally extending side walls, an upwardly facing outer surface adapted to engage a resilient fastener, a bottom surface adapted to engage said rail brace top surface and a downwardly depending leg adapted to be received in said through opening defined in said brace plate and having a first bearing surface for engaging said rail brace vertical front bearing surface and a second bearing surface for engaging said wall defining said brace plate opening to cause lateral loads applied to said brace and said bearing insert to be resisted by said brace plate wall;

a shoulder rigidly secured to the top surface of said brace plate having an opening for receiving one leg of a resilient fastener; and a resilient fastener having one leg adapted to be inserted into said shoulder opening and another leg adapted to engage said insert top surface to apply a downwardly acting force on said top surface to resist rotational movement of said rail brace.

2. The rail brace assembly of claim 1 which further comprises:

longitudinal stop means on said rail brace for preventing longitudinal movement of said rail brace.

3. The rail brace assembly of claim 2 in which:

said longitudinal stop means includes an integral lug formed on the bottom surface of said rail brace;

a second through opening defined in said brace plate for receiving said lug; and capture means for capturing said lug within said second opening when said rail brace upper and lower surfaces engage said head and base fishing surfaces to prevent longitudinal movement of said rail brace.

4. The rail brace assembly of claim 1 which further comprises:

a lateral projection formed on the main body portion of said bearing insert which projects away from said rail braces; and wherein said lateral projection overlies the top surface of said brace plate and has a bottom face adapted to engage the top surface of said brace plate adjacent said shoulder.

5. The rail brace assembly of claim 4 in which:

said shoulder defines a recess adjacent said brace plate opening; and

6. The rail brace assembly of claim 1 in which:

said rail brace further comprises receiving means for receiving said bearing insert to prevent longitudinal movement of said insert.

7. The rail brace assembly of claim 6 in which:

said receiving means comprises a cavity formed in said rail brace defined partially by a pair of spaced walls and a lateral ridge which intersects said spaced walls; and wherein said main body portion of said bearing insert lies within said cavity to overlie said bearing top surface and extends between said pair of spaced walls.

8. The rail brace assembly of claim 1 further comprising:

a longitudinally extending ramp formed in the top surface of the bearing insert; and wherein one end of said ramp commences at one of said side walls to ease installation of said resilient fastener on said top surface.

9. The rail brace assembly of claim 1 in which:

said rail brace has an upper bearing surface adapted to engage said bearing insert above said front bearing surface.

10. The rail brace assembly of claim 9 in which:

upper bearing surface lies within a lateral ridge formed on said rail brace adjacent one edge of said upwardly facing top surface.

11. The rail brace assembly of claim 10 in which:

the main body of said bearing insert has a third bearing surface adapted to engage said rail brace upper bearing surface when lateral loads are applied to said rail brace by said rail.

12. The rail brace assembly of claim 11 in which:

said upwardly facing top surface of said rail brace is inclined at an angle which approximates the angle of inclination of said rail base fishing surface.

13. The rail brace assembly of claim 10 in which said main body portion of said bearing insert has a lateral projection which projects toward said shoulder; and wherein said lateral projection overlies the top surface of said brace plate and has a bottom face adapted to engage the top surface of said brace plate adjacent said shoulder.

* * * * *